US008310398B2

(12) United States Patent
Deng et al.

(10) Patent No.: US 8,310,398 B2
(45) Date of Patent: Nov. 13, 2012

(54) DUAL-BAND PLANAR MICRO-STRIP ANTENNA

(75) Inventors: Wei-Kung Deng, Taipei (TW); Shau-Gang Mao, Taipei (TW); Shiou-Li Chen, Taoyuan County (TW); Min-Sou Wu, Taoyuan County (TW); Yu-Zhi Chueh, Yilan County (TW); Jen-Chun Yeh, Taichung (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 550 days.

(21) Appl. No.: 12/610,338

(22) Filed: Nov. 1, 2009

(65) Prior Publication Data

US 2010/0238084 A1 Sep. 23, 2010

(30) Foreign Application Priority Data

Mar. 17, 2009 (TW) ..... 98108662 A

(51) Int. Cl.
*H01Q 1/38* (2006.01)

(52) U.S. Cl. ..... 343/700 MS; 343/770

(58) Field of Classification Search ..... 343/700, 343/767, 770

See application file for complete search history.

(56) References Cited

U.S. PATENT DOCUMENTS

| | | | | |
|---|---|---|---|---|
| 3,757,343 | A * | 9/1973 | Bogner | 343/770 |
| 4,101,896 | A * | 7/1978 | Ikrath et al. | 343/713 |
| 7,248,224 | B2 * | 7/2007 | Yuanzhu | 343/700 MS |
| 2003/0184484 | A1 * | 10/2003 | Ikegaya et al. | 343/767 |

* cited by examiner

*Primary Examiner* — Tho G Phan
(74) *Attorney, Agent, or Firm* — Winston Hsu; Scott Margo

(57) ABSTRACT

To meet the requirements including dual-band, a high gain, and a broadside radiation formation, a dual band planar micro-strip antenna utilizing antenna array is provided. One array element includes a rectangle-shaped micro-strip antenna and an arrow-shaped micro-strip antenna. A first resonant frequency is determined by a length of the rectangle-shaped micro-strip antenna. Slots are dug for satisfying a second resonance frequency. Curved surfaces of the arrow-shaped micro-strip antenna designed according to an ellipse equation so that a frequency resonance is reached under both the first resonant frequency and a second resonant frequency, and a broadside radiation formation is thus generated. A T-shaped jointer distributes power between antenna elements according to the output impedances of the antenna elements. An L-shaped band-stop filter located on the T-shaped jointer is utilized to suppress frequency resonance resulted from multiples of the first resonant frequency.

30 Claims, 9 Drawing Sheets

DUAL-BAND PLANAR MICRO-STRIP ANTENNA

BACKGROUND OF THE INVENTION

1. Field of the Invention

The present invention relates to a micro-strip antenna, and more particularly, to a dual-band planar micro-strip antenna.

2. Description of the Prior Art

A micro-strip antenna is an antenna formed by attaching conductive slices on dielectric plates having conductive ground plates. A micro-strip antenna may be implemented with conductive lines including micro-strip lines or coplanar lines so as to generate a radio frequency electromagnetic field between the conductive slices and the conductive ground plates, and so as to have the radio frequency electromagnetic field emit outwards through slots between the conductive slices and the conductive ground plates. Usually, thicknesses of the dielectric plates of the micro-strip antenna is significantly less than a wavelength of a corresponding resonant frequency, therefore, while the micro-strip antenna is applied on a wireless communication device, a volume of the wireless communication device is significantly reduced. The conductive slice attached on the micro-strip is conventionally a planar unit having a regular geometric shape, for example, a rectangle, a circle, a ring, or a quadrangle. The micro-strip antenna also emits radio signals by deformation including curves or right-angle turns of the micro-strips. In comparison of conventional antenna for transmitting microwave signals, benefits of the micro-strip antenna include light weight, low profile, flexible radiation pattern, multi-band operation, and easy integration with other active and passive components. However, the disadvantages of the micro-strip antenna also include a narrow operating bandwidth, radiation reduction caused by lossy dielectric material, and a smaller power capability. Therefore, meeting requirements including dual-band properties, a high gain, and a broadside radiation formation is getting important while developing micro-strip antennas.

SUMMARY OF THE INVENTION

The claimed invention discloses a dual-band planar micro-strip antenna. The dual-band planar micro-strip antenna comprises an antenna array. The antenna array comprises a rectangle-shaped micro-strip antenna and an arrow-shaped micro-strip antenna. The rectangle-shaped micro-strip antenna has a first slot and a second slot. The rectangle-shaped micro-strip antenna is electrically connected to a signal feed-in terminal. The arrow-shaped micro-strip antenna is electrically connected to the rectangle-shaped micro-strip antenna through a first micro-strip line. The first slot is disposed close to the arrow-shaped micro-strip antenna and on the rectangle-shaped micro-strip antenna. The second slot is disposed close to the signal feed-in terminal and on the rectangle-shaped micro-strip antenna.

The claimed invention discloses a dual-band planar micro-strip antenna. The dual-band planar micro-strip antenna comprises a first antenna array, a second antenna array, and a T-shaped jointer. The first antenna array comprises a first rectangle-shaped micro-strip antenna and a first arrow-shaped micro-strip antenna. The first rectangle-shaped micro-strip antenna comprises a first slot and a second slot. The first arrow-shaped micro-strip antenna is electrically connected to the first rectangle-shaped micro-strip antenna through a first micro-strip line. The second antenna array comprises a second rectangle-shaped micro-strip antenna and a second arrow-shaped micro-strip antenna. The second rectangle-shaped micro-strip antenna comprises a third slot and a fourth slot. The second arrow-shaped micro-strip antenna is electrically connected to the second rectangle-shaped micro-strip antenna through a second micro-strip line. The T-shaped jointer has a first terminal electrically connected to the first antenna array through a third micro-strip, has a second terminal electrically connected to the second antenna array through a fourth micro-strip line, and has a third terminal electrically connected to a signal feed-in terminal. The first slot is disposed close to the first arrow-shaped micro-strip antenna and on the first rectangle-shaped micro-strip antenna. The second slot is disposed close to the first terminal of the T-shaped jointer and on the first rectangle-shaped micro-strip antenna. The third slot is disposed close to the second arrow-shaped micro-strip antenna and on the second rectangle-shaped micro-strip antenna. The fourth slot is disposed close to the second terminal of the T-shaped jointer and on the second rectangle-shaped micro-strip antenna.

The claimed invention discloses a dual-band planar micro-strip antenna. The dual-band planar micro-strip antenna comprises N first antenna arrays, N second antenna arrays, and N T-shaped jointers. Each of the first antenna arrays comprises an N1-th rectangle-shaped micro-strip antenna and an N1-th arrow-shaped micro-strip antenna. The N1-th rectangle-shaped micro-strip antenna comprises an N11-th slot and an N12-th slot. The N1-th arrow-shaped micro-strip antenna is electrically connected to the N1-th rectangle-shaped micro-strip antenna through an N1-th micro-strip line. Each of the second antenna arrays comprises an N2-th rectangle-shaped micro-strip antenna and an N2-th arrow-shaped micro-strip antenna. The N2-th rectangle-shaped micro-strip antenna comprises an N21-th slot and an N22-th slot. The N2-th arrow-shaped micro-strip antenna is electrically connected to the N2-the rectangle-shaped micro-strip antenna through an N2-th micro-strip line. Each of the T-shaped jointers has a first terminal electrically connected to the first antenna array through an N3-th micro-strip line, has a second terminal electrically connected to the second antenna array through an N4-th micro-strip line, and has a third terminal electrically connected to a signal feed-in terminal through a micro-strip line. A length of a long component of a L-shaped component of the T-shaped jointer is equal to a resonant length of a resonant frequency to be suppressed. The N11-th slot is disposed close to the N1-th arrow-shaped micro-strip antenna and on the N1-th rectangle-shaped micro-strip antenna. The N12-th slot is disposed close to the first terminal of the T-shaped jointer and on the N1-th rectangle-shaped micro-strip antenna. The N21-th slot is disposed close to the N2-th arrow-shaped micro-strip antenna and on the N2-th rectangle-shaped micro-strip antenna. The N22-th slot is disposed close to the second terminal of the T-shaped jointer and on the N2-th rectangle micro-strip antenna.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components . As one skilled in the art will appreciate, manufacturers may refer to a component by different names. This document does not intend to distinguish between components that differ in name but in function. In the following discussion and in the claims, the terms "include", "including", "comprise", and "comprising" are used in an open-ended fashion, and thus should be interpreted to mean "including, but not limited to . . .". Also, the term "electrically connect" is intended to mean either a direct or an indirect electrical connection. Accordingly, if one device is electrically connected to another device, the electrical connection may be through a direct electrical connection, or through an indirect electrical connection via other devices and connections.

For matching requirements of a micro-strip antenna in dual-band operation, high gain, and a broadside radiation formation, a dual-band antenna is disclosed in the present invention. The disclosed dual-band antenna primarily includes a first component, a second component, and a jointer as the feed network of antenna arrays. The first component may be quadrangle-shaped, and is rectangle-shaped in one embodiment of the present invention. The second component may be curve-shaped, and has an arrow-shaped streamline pattern in one embodiment of the present invention. The disclosed dual-band antenna operates under two resonant frequencies, where one of the resonant frequencies is determined according to a length of the dual-band antenna, for example, a length of a later-mentioned rectangle-shaped antenna. The other resonant frequency is related to lengths of slots on the first component. The disclosed dual-band antenna may be a micro-strip antenna.

In one embodiment of the present invention, a curve surface of the arrow-shaped micro-strip antenna may be designed according to an ellipse equation so that the dual-band antenna can be resonant under both the abovementioned resonant frequencies, which are denoted as a first resonant frequency and a second resonant frequency hereafter, to form a broadside radiation formation. The jointer may be T-shaped and can transmit power between the antenna arrays and the feed-in terminal according to output impedances of the antenna arrays. An L-shaped notch filter may be disposed on the T-shaped jointer to suppress resonance under multiples of the first resonant frequency.

Figure 1:
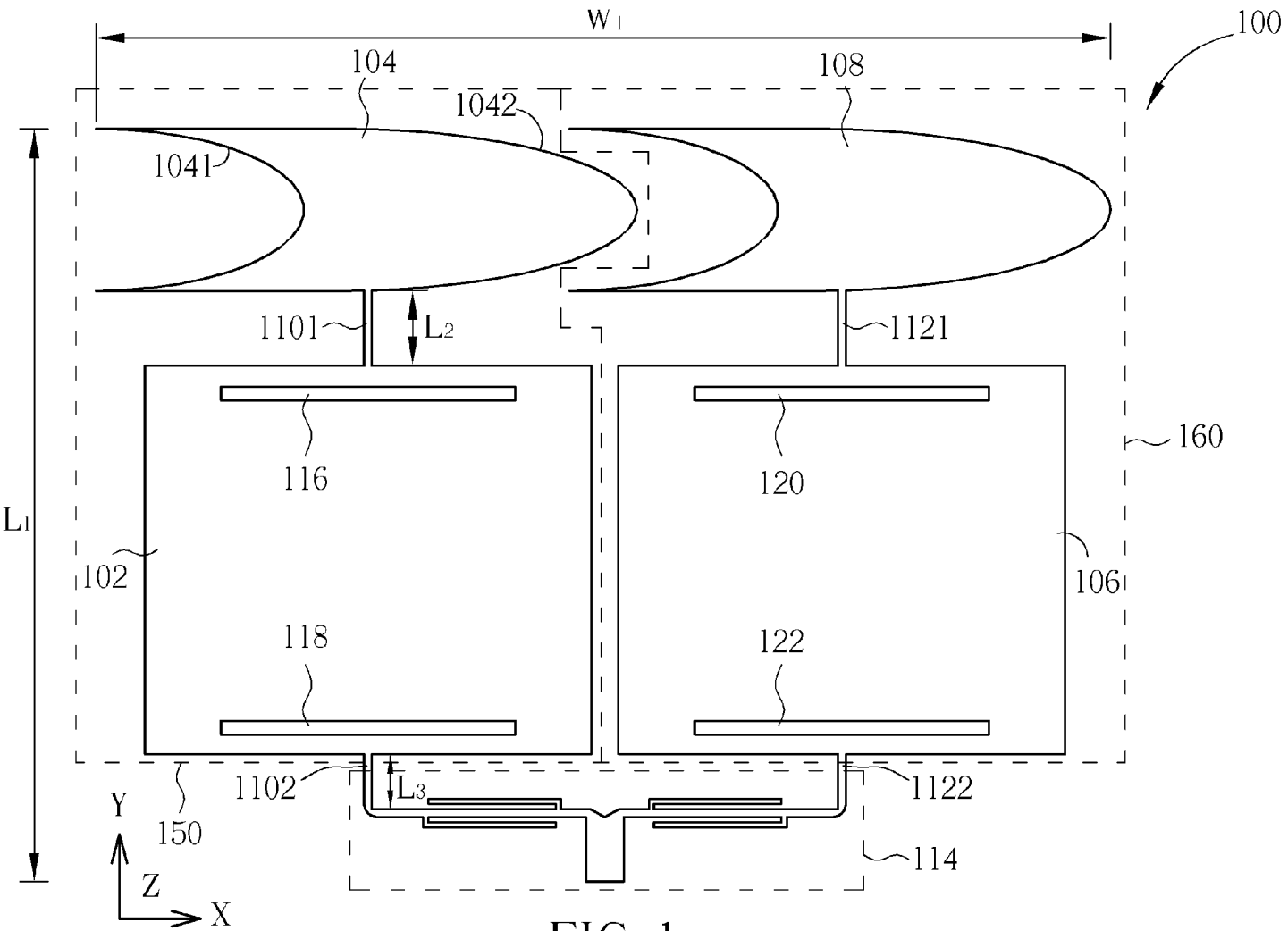
FIG. 1 is a schematic diagram of a single dual-band planar micro-strip antenna disclosed in the present invention.

Please refer to FIG. 1, which is a schematic diagram of a single dual-band planar micro-strip antenna disclosed in the present invention, where the disclosed dual-band planar micro-strip antenna may be regarded as a micro-strip antenna module. As shown in FIG. 1, a dual-band planar micro-strip antenna 100 includes a first antenna array 150, a second antenna array 160, and a T-shaped jointer 114. The first antenna array 150 includes a first rectangle-shaped micro-strip antenna 102 and a first arrow-shaped micro-strip antenna 104. The first rectangle-shaped micro-strip antenna 102 includes a first slot 116 and a second slot 118. The first arrow-shaped micro-strip antenna 104 is electrically connected to the first rectangle-shaped micro-strip antenna 102 through a first micro-strip line 1101. The T-shaped jointer 114 has a first terminal electrically connected to the first antenna array 150 through a second micro-strip line 1102. The second antenna array 106 includes a third slot 120 and a fourth slot 122. The second arrow-shaped micro-strip antenna 108 is electrically connected to the second rectangle-shaped micro-strip antenna 106 through a third micro-strip line 1121. The second rectangle-shaped micro-strip antenna 106 is electrically connected to a second terminal of the T-shaped jointer 114 through a fourth micro-strip line 1122. As shown in FIG. 1, the first slot 116 is disposed close to the first arrow-shaped micro-strip antenna 104 and on the first rectangle-shaped micro-strip antenna 102. The second slot 118 is disposed close to the first terminal of the T-shaped jointer 114 and on the second rectangle-shaped micro-strip antenna 106. The fourth slot 122 is disposed close to the second terminal of the T-shaped jointer 114 and on the second rectangle-shaped micro-strip antenna 106.

The dual-band planar micro-strip antenna 100 shown in FIG. 1 is designed for transmitting wireless signals under a first resonant frequency and a second resonant frequency. For the dual-band planar micro-strip antenna 100 operating under the first and second resonant frequencies, both locations and lengths of elements of the dual-band planar micro-strip antenna 100 have to be strictly designed.

Figure 2:
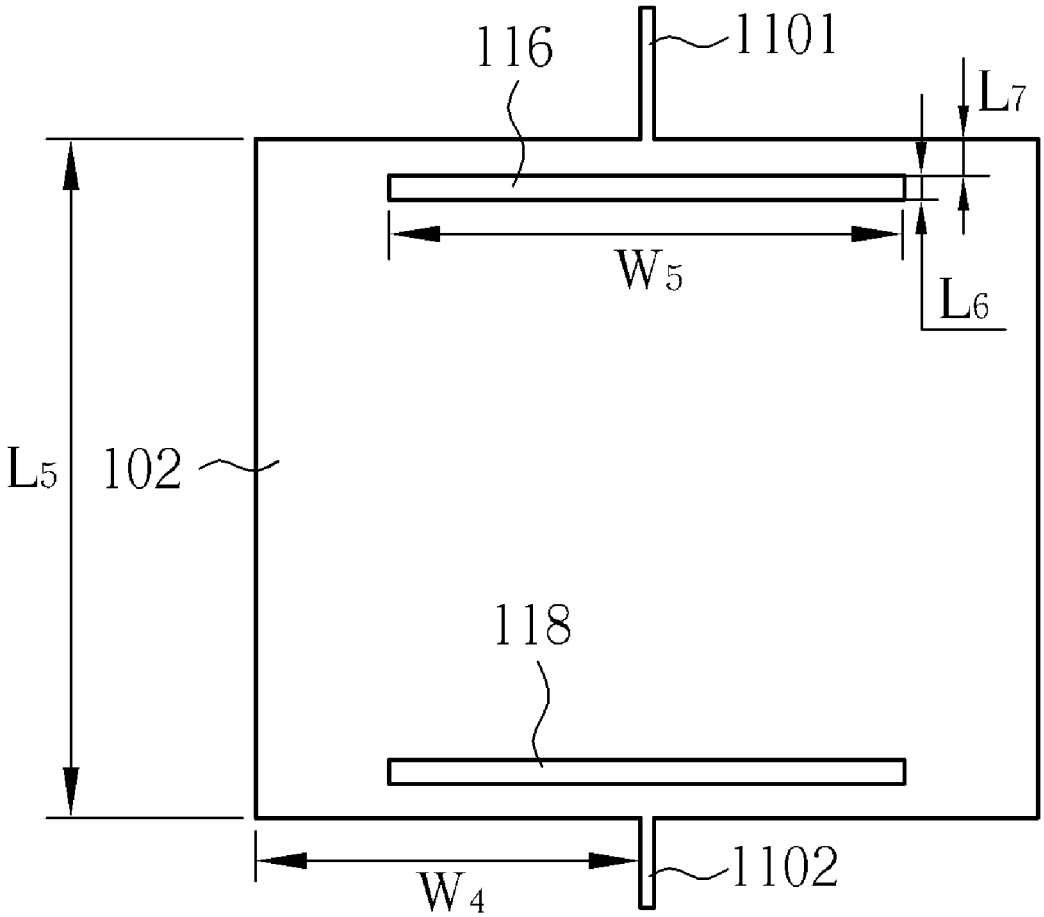
FIG. 2 is a detailed diagram of the first rectangle-shaped micro-strip antenna of the dual-band planar micro-strip antenna shown in FIG. 1.

Please refer to FIG. 2, which is a detailed diagram of the first rectangle-shaped micro-strip antenna 102 of the dual-band planar micro-strip antenna 100 shown in FIG. 1. For the first rectangle-shaped micro-strip antenna 102 operating under the first resonant frequency, lengths of both sides without the first and second slots 116 and 118 on the first rectangle-shaped micro-strip antenna 102, which are the length $L_5$ shown on FIG. 2, are designed to be equal to multiples of a least common multiple of a half wavelength of the first resonant frequency and a wavelength of the second resonant frequency. For operating the first rectangle-shaped micro-strip antenna 102 under the second resonant frequency as well, the first rectangle-shaped micro-strip antenna 102 is operated under the first resonant frequency in advance to search for locations having smaller current distributions on the first rectangle-shaped micro-strip antenna 102, and then said locations are disposed with both the first slot 116 and the second slot 118, i.e., the locations close to both the first arrow-shaped micro-strip antenna 104 and the first terminal of the T-shaped jointer 114 and on the first rectangle-shaped micro-strip antenna 102 as shown in FIG. 1. Note that a half length of an upper side or a lower side, i.e., the length $W_4$ shown in FIG. 2, is equal to a multiple of a least common multiple of a first length and a second length, where the first length indicates a quarter wavelength of the first resonant frequency, the second length indicates a half wavelength of the second resonant frequency. Also note that the upper side or the lower side of the first rectangle-shaped micro-strip antenna 102 is located nearby the slot 116 or the slot 118 respectively. Besides, lengths of both the first and second slots 116 and 118 are designed to be a multiple of the wavelength of the second resonant frequency so as to transmit radio signals under the second resonant frequency, and so as to prevent radiation properties of the first rectangle-shaped micro-strip antenna 102 under low frequencies from being effected. Note that specifications of the second rectangle-shaped micro-strip antenna 106 are the same with the specifications of the first rectangle-shaped micro-strip antenna 102 so that the descriptions about the first rectangle-shaped micro-strip antenna 102 also work for the second rectangle-shaped micro-strip antenna 106.

Figure 3:
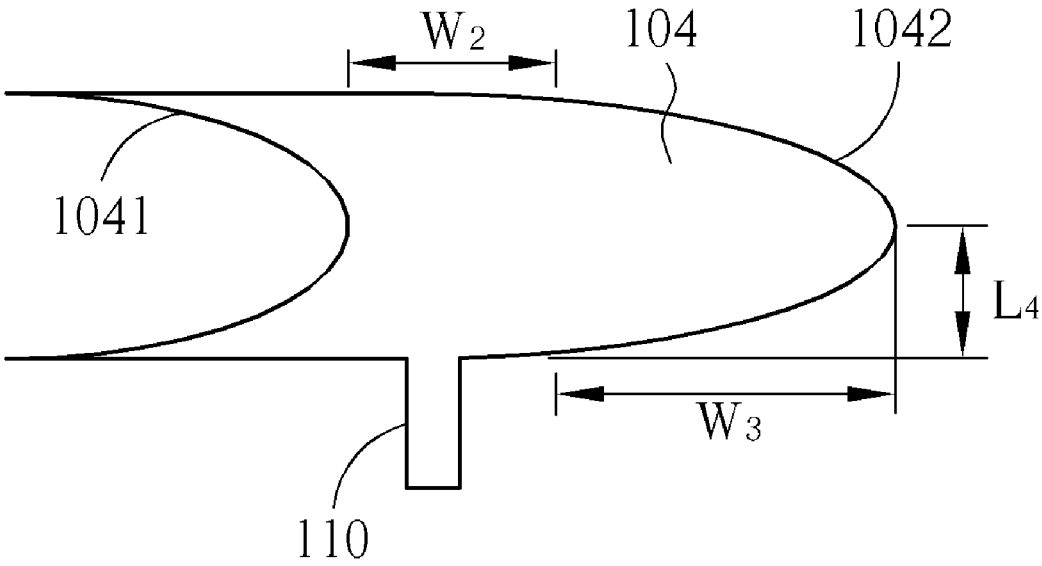
FIG. 3 is a detailed diagram of the first arrow-shaped micro-strip antenna of the dual-band planar micro-strip antenna shown in FIG. 1.

Please refer to FIG. 3, which is a detailed diagram of the first arrow-shaped micro-strip antenna 104 of the dual-band planar micro-strip antenna 100 shown in FIG. 1. The first arrow-shaped micro-strip antenna 104 includes a first curved surface 1041 and a second curved surface 1042. The first arrow-shaped micro-strip antenna 104 is primarily used for changing resonant path of the first arrow-shaped micro-strip antenna 104 in transmitting radio signals with the aid of both the first and second curved surfaces 1041 and 1042, and therefore, the first arrow-shaped micro-strip antenna 104 may achieve a broadside radiation formation while the dual-band planar micro-strip antenna 100 is operated under both the first and second resonant frequencies. Both the first and second curved surfaces 1041 and 1042 fit a same ellipse equation, which may be adapted by adjusting both a length of a semi-major axis, i.e., the length $W_3$ shown in FIG. 3, and a length of a semi-minor axis, i.e., the length $L_4$ shown in FIG. 3, and a resonant frequency of the first arrow-shaped micro-strip antenna 104 may thereby be controlled by adjusting said ellipse equation. Note that specifications of the first and second arrow-shaped micro-strip antenna 104 and 108 are the same and fit the same ellipse equation so that the descriptions about the first arrow-shaped micro-strip antenna 104 work for the second arrow-shaped micro-strip antenna 108 as well. Besides, although both the first and second slots 116 and 118 on the first rectangle-shaped micro-strip antenna 102 may disturb the broadside radiation formation of the dual-band planar micro-strip antenna 100 under high frequencies, such disturbances maybe perfectly compensated by the first arrow-shaped micro-strip antenna 104.

Figure 4:
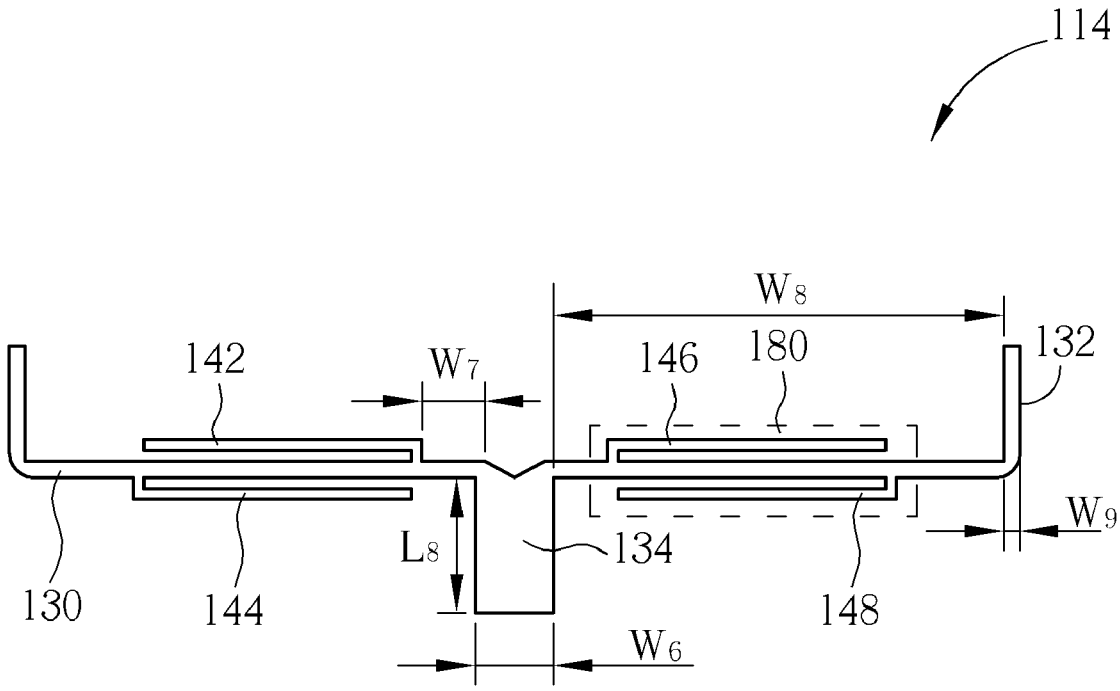
FIG. 4 is a detailed diagram of the T-shaped jointer of the dual-band planar micro-strip antenna shown in FIG. 1.

Please refer to FIG. 4, which is a detailed diagram of the T-shaped jointer 114 of the dual-band planar micro-strip antenna 100 shown in FIG. 1. As shown in FIG. 4, the T-shaped jointer 114 includes a first L-shaped component 130, a second L-shaped component 132, and a middle component 134. The first L-shaped component 130 is disposed on the left side of the T-shaped jointer 114, and the first L-shaped component 130 has a first terminal electrically connected to the first terminal of the T-shaped jointer 114. The second L-shaped component 132 is disposed at the right side of the T-shaped jointer 130, has a first terminal connected to a second terminal of the first L-shaped component 130, and has a second terminal electrically connected to the second terminal of the T-shaped jointer 114. The middle component 134 is disposed at middle of the T-shaped jointer 124, and has a first terminal electrically connected to the second terminal of the first L-shaped component 130.

Impedance of a micro-strip antenna is a primary factor for the resonant frequency used by the micro-strip antenna, and is also critical for the dual-band planar micro-strip antenna 100 disclosed in the present invention. Therefore, in the T-shaped jointer 114, input impedances of both the second micro-strip line 1102 and the fourth micro-strip line 1122 are determined by an output impedance of the T-shaped jointer 114, so that the dual-band planar micro-strip antenna 100 maybe operated under both the first and second resonant frequencies. In other words, the T-shaped jointer 114 acts as a power distributer for both the first and second antenna arrays 150 and 160. In a preferred embodiment of the present invention, input impedances of the second and fourth micro-strip lines 1102 and 1122 equal to the output impedance of the T-shaped jointer 114. Besides, lengths of long components of both the first and second L-shaped components 130 and 132, i.e., the length $W_8$ shown in FIG. 4, equal to a multiple of a least common multiple of a quarter wavelength of the first resonant frequency and a half wavelength of the second resonant frequency.

Figure 5:
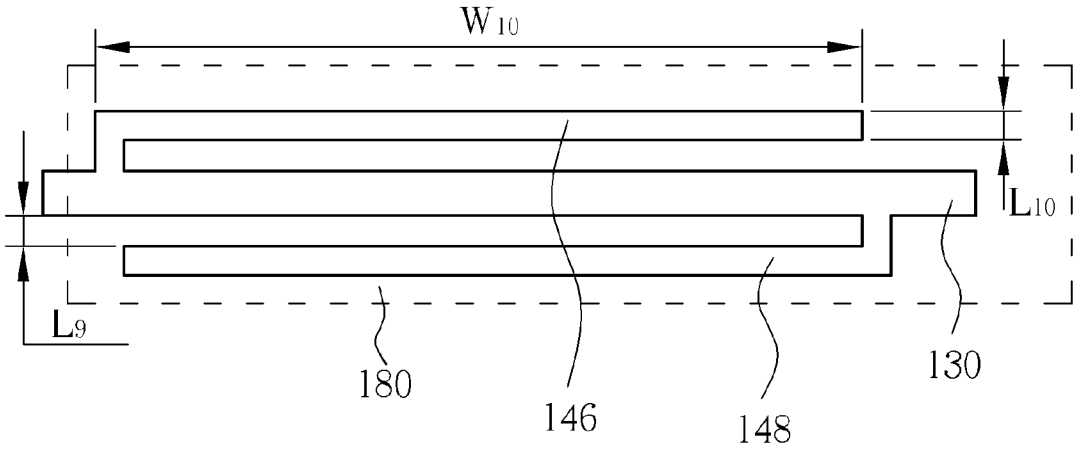
FIG. 5 is a detailed diagram of notch filters disposed on the T-shaped jointer shown in FIG. 4 and marked with a dotted region shown on FIG. 4 as well.

Although the T-shaped jointer 114 may have the dual-band planar micro-strip antenna 100 be perfectly operated under both the first and second resonant frequencies according to the above descriptions; however, while the dual-band planar micro-strip antenna 100 is effected by radio signals of multiples of the first resonant frequency, additional resonances arise so that transmission of the dual-band planar micro-strip antenna 100 is disturbed. To avoid this disadvantage, a plurality of L-shaped notch filters is added on the T-shaped jointer 114 shown in FIG. 4. Please refer to FIG. 4 and FIG. 5. FIG. 5 is a detailed diagram of notch filters disposed on the T-shaped jointer 114 shown in FIG. 4 and marked with a dotted region 180 shown on FIG. 4 as well. As shown in FIG. 4, the T-shaped jointer 114 further includes a fist L-shaped notch filter 142, a second L-shaped notch filter 144, a third L-shaped notch filter 146, and a fourth L-shaped notch filter 148. The first L-shaped notch filter 142 is disposed along a first side of the first L-shaped component 130, and has a first terminal electrically connected to the first side of the first L-shaped component 130. The second L-shaped notch filter 144 is disposed along a second side of the first L-shaped component 130, and has a first terminal electrically connected to the second side of the first L-shaped component 130. The third L-shaped notch filter 146 is disposed along a first side of the second L-shaped component 132, and has a first terminal electrically connected to the first side of the second L-shaped component 132. The fourth L-shaped notch filter 148 is disposed along a second side of the second L-shaped component 132, and has a first terminal electrically connected to the second side of the second L-shaped component 132. For briefly describing usages of the added L-shaped notch filters of the T-shaped jointer 114, merely both the third and fourth L-shaped notch filters 146 and 148 are illustrated in FIG. 5. As shown in FIG. 5, a length and a width of one side along the second L-shaped component 132 and respectively on the third and fourth L-shaped notch filters 146 and 148, i.e., the length $W_{10}$ and the width $L_{10}$ shown on FIG. 5, equal to a multiple of a quarter wavelength of a third resonant frequency. A gap length between the second L-shaped component 132 and each of the third and fourth L-shaped notch filters 146 and 148, i.e., the width $L_9$ shown on FIG. 5, equals to a multiple of a quarter wavelength of the third resonant frequency. With the above-mentioned disposition, the disturbances from the radio signals of the multiples of the first resonant frequency can be eliminated. Note that specifications and dispositions of both the first and second L-shaped notch filters 142 and 144 are the same with those of both the third and fourth L-shaped notch filters 146 and 148, and are related to the third resonant frequency. Therefore, specifications and dispositions of both the first and second L-shaped notch filters 142 and 144 are not repeatedly described herein.

In a preferred embodiment of the present invention, the first resonant frequency is 2.4 GHz, and the second resonant frequency is 5.8 GHz. While the preferred embodiment is implemented under resonant frequencies of both 2.4 GHz and 5.8 GHz, specifications and related lengths are described as follows and marked from FIG. 1 to FIG. 5. A length of each the side without the first slot 116 or the second slot 118 and on the first rectangle-shaped micro-strip antenna 102, i.e., the length $L_5$ shown in FIG. 2, equals to 29.6 mm. A half of the lengths of both sides disposed with the first and second slots 11 and 118 and on the first rectangle-shaped micro-strip antenna 102, i.e., the length $W_4$ shown on FIG. 2, equals to 16.65 mm. A width of the first slot 116 or the second slot 118, i.e., the length $L_7$ shown on FIG. 2, is 1 mm. On the first arrow-shaped micro-strip antenna 104, a length, i.e., the length $W_3$ shown on FIG. 3, of the semi-major axis of the ellipse equation, which is fit by both the first and second curved surfaces 1041 and 1042, is 17 mm, whereas a length, i.e., the length $L_4$ shown on FIG. 3, of the semi-minor axis of said ellipse equation is 5.93 mm. A vertical gap length between the first curved surface 1041 and the second curved surface 1042, i.e., the length $W_2$ shown on FIG. 3, is 7.5 mm. A length of the long component of the first L-shaped component 130 or the second L-shaped component 132, i.e., the length $W_8$ shown on FIG. 4, is 16.15 mm. A length of a short component of the first L-shaped component 130 or the second L-shaped component 132, i.e., the length $W_9$ shown on FIG. 4, is 0.7 mm. A length of the middle component 134, i.e., the length $W_6$ shown on FIG. 4, is 3 mm. A length of one side disposed along the first L-shaped component 130 and on the first L-shaped notch filter 142, a length of one side disposed along the first L-shaped component 130 and on the second L-shaped notch filter 144, a length of one side disposed along the second L-shaped component 132 and on the third L-shaped notch filter 146, and a length of one side disposed along the second L-shaped component 132 and on the fourth L-shaped notch filter 148, i.e. the length $W_{10}$ shown on FIG. 5, are all 10 mm. A width of one side disposed along the first L-shaped component 130 and on the first L-shaped notch filter 142, a width of one side disposed along the first L-shaped component 130 and on the second L-shaped notch filter 144, a width of one side disposed along the second L-shaped component 132 and on the third L-shaped notch filter 146, and a width of one side disposed along the second L-shaped component 132 and on the fourth L-shaped notch filter 148, i.e., the length $L_{10}$ shown on FIG. 5, are all 0.3 mm. A gap length between the first L-shaped notch filter 142 and the first L-shaped component 130, a gap length between the second L-shaped notch filter 144 and the first L-shaped component 130, a gap length between the third L-shaped notch filter 146 and the second L-shaped component 132, and a gap length between the fourth L-shaped notch filter 148 and the second L-shaped component 132, i.e., the length $L_9$ shown on FIG. 5, are all 0.3 mm. A gap length between an edge of the first rectangle-shaped micro-strip antenna 102 and each of the first slot 116 and the second slot 118, and a gap length between an edge of the second rectangle-shaped micro-strip antenna 106 and each of the third slot 120 and the fourth slot 122, i.e., the length $L_7$ shown on FIG. 2, are all 1.6 mm. A gap length between the first rectangle-shaped micro-strip antenna 102 and the first arrow-shaped micro-strip antenna 104, and a gap length between the second rectangle-shaped micro-strip antenna 106 and the second arrow-shaped micro-strip antenna 108, i.e., the length $L_2$ shown on FIG. 1, are all 6 mm. A gap length between the first rectangle-shaped micro-strip antenna 102 and the long component of the first L-shaped component 130, and a gap length between the second rectangle-shaped micro-strip antenna 106 and the long component of the second L-shaped component 132, i.e., the length $L_3$ shown on FIG. 1, are all 4 mm. A length of the dual-band planar micro-strip antenna 100, i.e., the length $L_1$ shown on FIG. 1, is 56.7 mm. A width of the dual-band planar micro-strip antenna 100, i.e., the length $W_1$ shown on FIG. 1, is 76.5 mm. A gap length between the middle component 134 and each of the first, second, third, fourth L-shaped notch filters 142, 144, 146, 148, i.e., the length $W_7$ shown on FIG. 4, is 2 mm. Lengths of the first and second slots 116 and 118 are all 10.8 mm. Similarly, lengths of the third and fourth slots 120 and 122 are all 10.8 mm as well. Specifications of elements of the second antenna array 160 are the same with those of the first antenna array 150 so that the specifications of elements of the first antenna array 150 are not repeatedly described herein. Besides, the input impedance of the T-shaped jointer 114 is 50 ohm. The output impedances at both the first and second terminals of the T-shaped jointer 114 are 100 ohm. Input impedances of both the second and fourth 1102 and 1122 are 100 ohm. A dielectric coefficient of a base plate used on the dual-band planar micro-strip antenna 100 is 4.4. A thickness of the base plate is 1.6 mm. tan δ of the base plate is 0.022. A metal thickness of the base plate is 35 μm.

Figure 6:
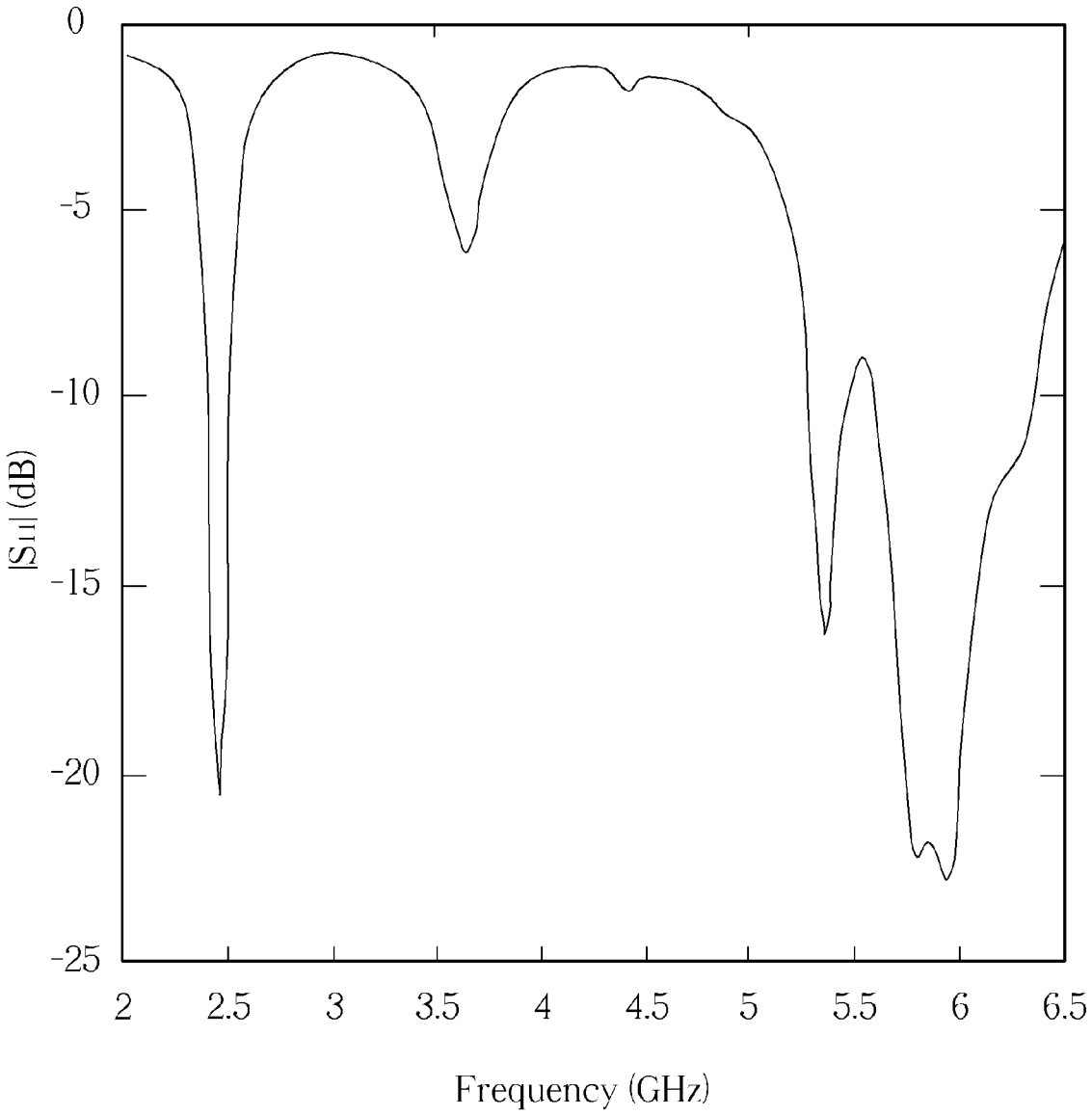
FIG. 6 is a statistic diagram of reflection coefficients measured according to the embodiment shown on FIG. 5 and for the disclosed dual-band planar micro-strip antenna of the present invention.

Please refer to FIG. 6, which is a statistic diagram of reflection coefficients measured according to the embodiment shown on FIG. 5 and for the disclosed dual-band planar micro-strip antenna 100 of the present invention. As shown in FIG. 6, a reflection coefficient under the first resonant frequency ranged from 2.4 GHz to 2.5 GHz is less than −10 dB, whereas a reflection coefficient under the second resonant frequency ranged from 5.59 GHz to 6.34 GHz is less than −10 dB as well.

Figure 7:
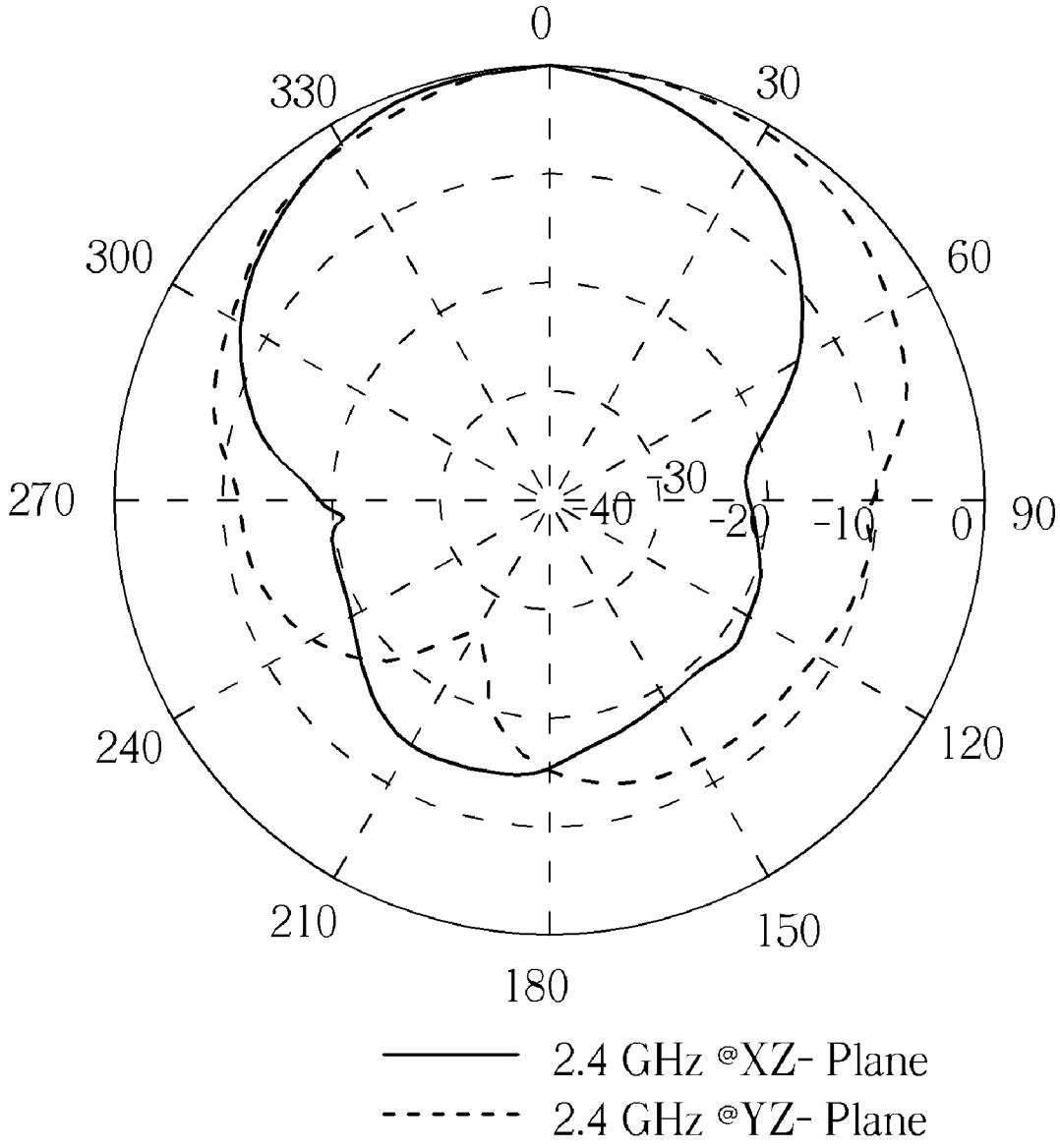
FIG. 7 illustrates a radiation formation on both XZ-plane and YZ-plane shown on FIG. 1 while the dual-band planar micro-strip antenna shown in FIG. 1 is measured under the first resonant frequency being 2.4 GHz and according to the embodiment shown in FIG. 5.
Figure 8:
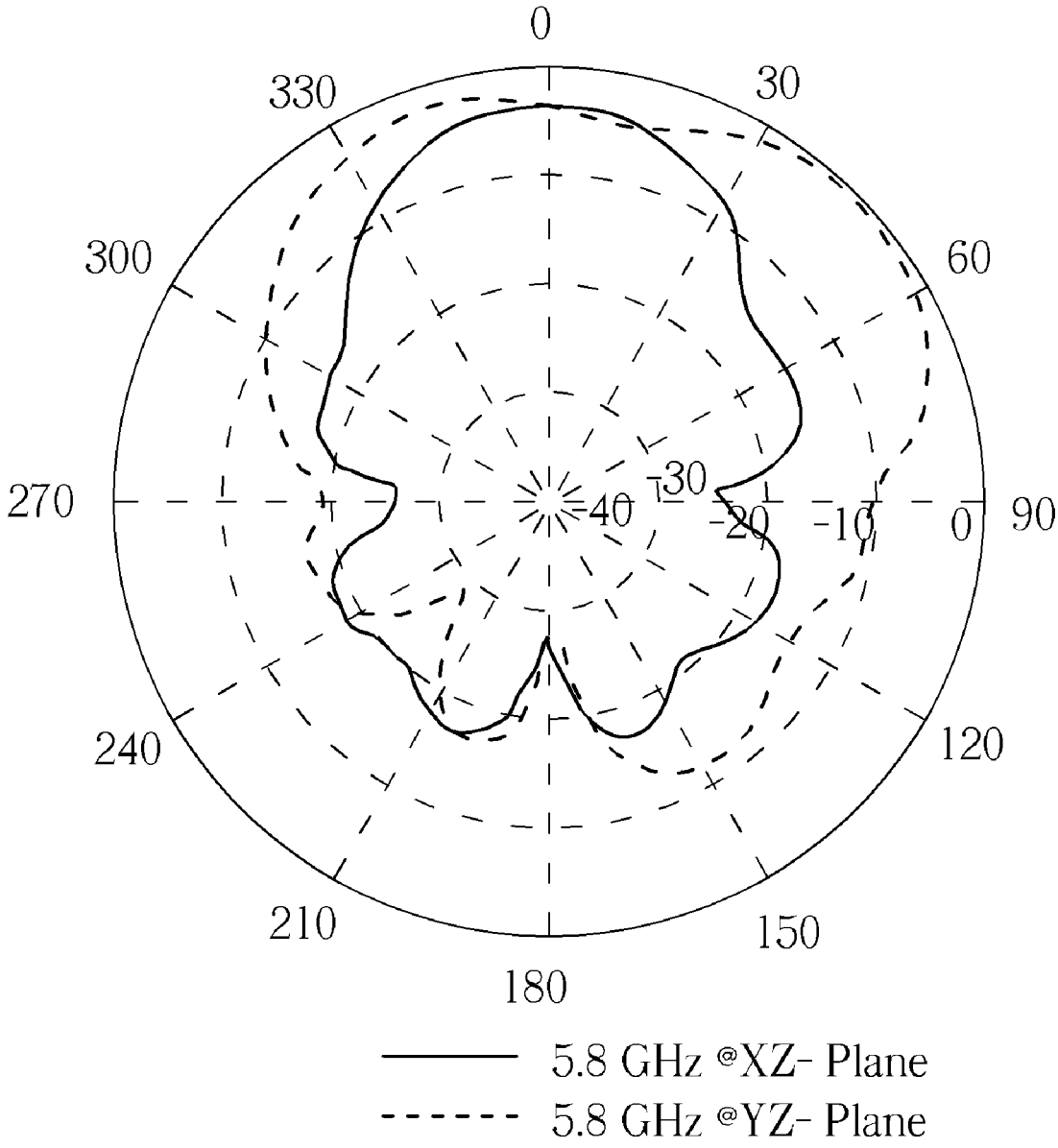
FIG. 8 illustrates a radiation formation on both XZ-plane and YZ-plane shown on FIG. 1 while the dual-band planar micro-strip antenna shown in FIG. 1 is measured under the second resonant frequency being 5.8 GHz and according to the embodiment shown in FIG. 5.

Please refer to FIG. 7 and FIG. 8. FIG. 7 illustrates a radiation formation on both XZ-plane and YZ-plane shown on FIG. 1 while the dual-band planar micro-strip antenna 100 shown in FIG. 1 is measured under the first resonant frequency being 2.4 GHz and according to the embodiment shown in FIG. 5. FIG. 8 illustrates a radiation formation on both XZ-plane and YZ-plane shown on FIG. 1 while the dual-band planar micro-strip antenna 100 shown in FIG. 1 is measured under the second resonant frequency being 5.8 GHz and according to the embodiment shown in FIG. 5. As can be observed from FIG. 7, while the first resonant frequency is 2.4 GHz, the maximal measured gain is 3.63 dBi. Similarly, as can be observed from FIG. 8, while the second resonant frequency is 5.8 GHz, the maximal measured gain is 7.08 dBi.

Figure 9:
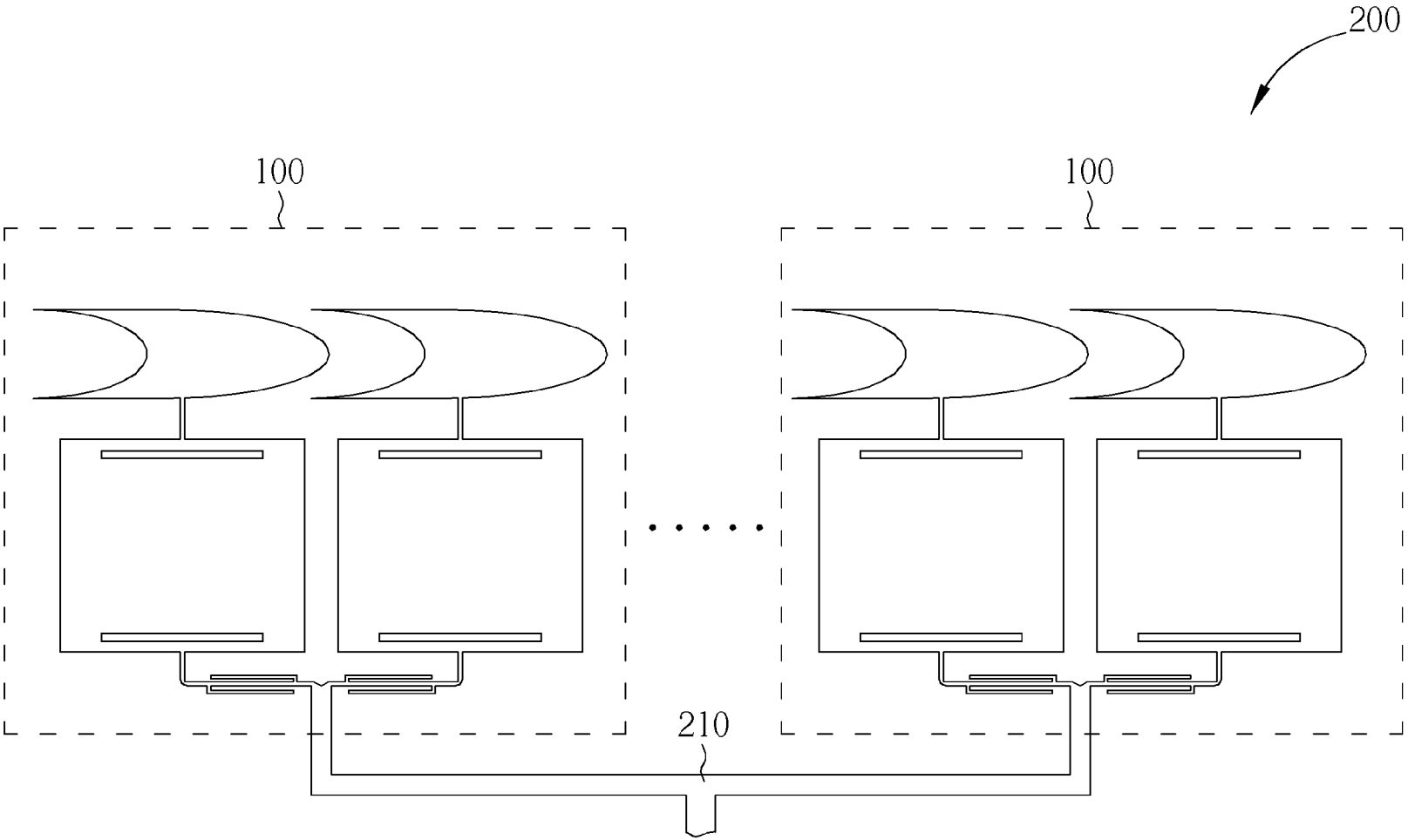
FIG. 9 is a diagram of a matrix-type dual-band planar micro-strip antenna formed by gathering a plurality of dual-band planar micro-strip antennas shown in FIG. 1.

Except for the dual-band planar micro-strip antenna 100 shown in FIG. 1, in another embodiment of the present invention, a plurality of the dual-band planar micro-strip antennas 100 may also be parallel-connected to form a matrix-type dual-band planar micro-strip antenna. Please refer to FIG. 9, which is a diagram of a matrix-type dual-band planar micro-strip antenna 200 formed by gathering a plurality of dual-band planar micro-strip antennas 100 shown in FIG. 1. As shown in FIG. 9, the dual-band planar micro-strip antenna 200 includes at least two dual-band planar micro-strip antennas 100, i.e., at least two micro-strip antenna modules. An input terminal of the T-shaped jointers 114 of the at least two dual-band planar micro-strip antennas 100 is electrically connected to a conductive wire 210, and in other words, the at least two dual-band planar micro-strip antennas 100 are parallel-connected through the conductive wire 210. An impedance of the conductive wire 210 is corresponding to the input impedance of each the T-shaped jointer 114. Specifications and dispositions of the dual-band planar micro-strip antenna 200 may be inducted according to the above descriptions so that the specifications and dispositions of the dual-band planar micro-strip antenna 200 are not further described.

The present invention discloses a dual-band planar micro-strip antenna for meeting requirements of micro-strip antennas including dual-band properties, high gains, and a broadside radiation formation. A matrix-type dual-band planar micro-strip antenna may also be generated by parallel-connecting a plurality of dual-band planar micro-strip antennas disclosed in the present invention.

Those skilled in the art will readily observe that numerous modifications and alterations of the device and method may be made while retaining the teachings of the invention.

What is claimed is:

1. A dual-band planar micro-strip antenna, comprising:

an antenna array, comprising:

a rectangle-shaped micro-strip antenna having a first slot and a second slot, the rectangle-shaped micro-strip antenna being electrically connected to a signal feed-in terminal; and an arrow-shaped micro-strip antenna electrically connected to the rectangle-shaped micro-strip antenna through a first micro-strip line;

wherein the first slot is disposed close to the arrow-shaped micro-strip antenna and on the rectangle-shaped micro-strip antenna, and the second slot is disposed close to the signal feed-in terminal and on the rectangle-shaped micro-strip antenna.

2. The dual-band planar micro-strip antenna of claim 1, wherein both the first slot and the second slot are rectangle-shaped, acute-triangle-shaped, trapezoid-shaped, or polygon-shaped;

wherein a longer side of the rectangle-shaped is vertical to a line crossing centers of both the first slot and the second slot.

3. The dual-band planar micro-strip antenna of claim 2, wherein the arrow-shaped micro-strip antenna comprises a first curved surface and a second curved surface;

wherein the first curved surface is concave, and the second curved surface is convex.

4. The dual-band planar micro-strip antenna of claim 3, wherein lengths of two parallel sides of the rectangle-shaped micro-strip antenna are equal to a resonance length between a first resonant frequency and a second resonant frequency, and both the parallel sides are parallel to the line crossing centers of both the first slot and the second slot.

5. The dual-band planar micro-strip antenna of claim 4, wherein lengths of longest diagonals of both the first slot and the second slot are equal to multiples of a half-wavelength of the second resonant frequency.

6. The dual-band planar micro-strip antenna of claim 4, wherein the antenna array further comprises:

a second micro-strip line connected between the signal feed-in terminal and the rectangle-shaped micro-strip antenna, the second micro-strip line comprising at least one L-shaped resonator.

7. The dual-band planar micro-strip antenna of claim 6, wherein a length of a side of the L-shaped resonator, the side being disposed along the second micro-strip line, is equal to a resonant length of a resonant frequency to be suppressed.

8. The dual-band planar micro-strip antenna of claim 2, wherein lengths of two parallel sides equal to a resonant length of a first resonant frequency and a second resonant frequency, and both the parallel sides are parallel to the line crossing centers of both the first slot and the second slot.

9. The dual-band planar micro-strip antenna of claim 2, wherein the arrow-shaped micro-strip antenna comprises a first curved surface and a second curved surface;

wherein the first curved surface is concave, and the second curved surface is convex.

10. The dual-band planar micro-strip antenna of claim 2, wherein the antenna array further comprises:

a second micro-strip line connected between the signal feed-in terminal and the rectangle micro-strip antenna, and the second micro-strip antenna comprises at least one L-shaped resonator.

11. The dual-band planar micro-strip antenna of claim 10, wherein a length of a side of the L-shaped resonator, the side being disposed along the second micro-strip line is equal to a resonant length of a resonant frequency to be suppressed.

12. A dual-band planar micro-strip antenna, comprising:

a first antenna array, comprising:

a first rectangle-shaped micro-strip antenna comprising a first slot and a second slot; and a first arrow-shaped micro-strip antenna connected to the first rectangle-shaped micro-strip antenna through a first micro-strip line;

a second antenna array, comprising:

a second rectangle-shaped micro-strip antenna comprising a third slot and a fourth slot; and a second arrow-shaped micro-strip antenna connected to the second rectangle-shaped micro-strip antenna through a second micro-strip line; and a T-shaped jointer having a first terminal connected to the first antenna array through a third micro-strip, having a second terminal electrically connected to the second antenna array through a fourth micro-strip line, and having a third terminal connected to a signal feed-in terminal;

wherein the first slot is disposed close to the first arrow-shaped micro-strip antenna and on the first rectangle-shaped micro-strip antenna, the second slot is disposed close to the first terminal of the T-shaped jointer and on the first rectangle-shaped micro-strip antenna, the third slot is disposed close to the second arrow-shaped micro-strip antenna and on the second rectangle-shaped micro-strip antenna, and the fourth slot is disposed close to the second terminal of the T-shaped jointer and on the second rectangle-shaped micro-strip antenna.

13. The dual-band planar micro-strip antenna of claim 12, wherein an orientation of the first arrow-shaped micro-strip antenna and an orientation of the second arrow-shaped micro-strip antenna are regularly identical.

14. The dual-band planar micro-strip antenna of claim 13, wherein the first antenna array further comprises:

a fourth micro-strip line located between the first terminal of the T-shaped jointer and the first rectangle-shaped micro-strip antenna, and the fourth micro-strip line comprises at least one L-shaped resonator.

15. The dual-band planar micro-strip antenna of claim 14, wherein a length of a side of the L-shaped resonator, the side being disposed along the fourth micro-strip line, is equal to a resonant length of a resonant frequency to be suppressed.

16. The dual-band planar micro-strip antenna of claim 13, wherein the second antenna array further comprises:

a fifth micro-strip line located between the second terminal of the T-shaped jointer and the second rectangle-shaped antenna, and the fifth micro-strip line comprises at least one L-shaped resonator.

17. The dual-band planar micro-strip antenna of claim 16, wherein a length of a side of the L-shaped resonator, the side is disposed along the fifth micro-strip line, is equal to a resonant length of a resonant frequency to be suppressed.

18. The dual-band planar micro-strip antenna of claim 12, wherein an orientation of the first arrow-shaped micro-strip antenna and an orientation of the second arrow-shaped micro-strip antenna are regularly opposite.

19. A dual-band planar micro-strip antenna, comprising:

N first antenna arrays, each of the first antenna arrays comprising:

an N1-th rectangle-shaped micro-strip antenna comprising an N11-th slot and an N12-th slot; and an N1-th arrow-shaped micro-strip antenna electrically connected to the N1-the rectangle-shaped micro-strip antenna through an N1-th micro-strip line;

N second antenna arrays, each of the second antenna arrays comprising:

an N2-th rectangle-shaped micro-strip antenna comprising an N21-th slot and an N22-th slot; and an N2-th arrow-shaped micro-strip antenna electrically connected to the N2-the rectangle-shaped micro-strip antenna through an N2-th micro-strip line; and N T-shaped jointers, each of the T-shaped jointers having a first terminal electrically connected to the first antenna array through an N3-th micro-strip line, having a second terminal electrically connected to the second antenna array through an N4-th micro-strip line, and having a third terminal electrically connected to a signal feed-in terminal through a micro-strip line;

wherein a length of a long component of an L-shaped component of the T-shaped jointer is equal to a resonant length of a resonant frequency to be suppressed;

wherein the N11-th slot is disposed close to the N1-th arrow-shaped micro-strip antenna and on the N1-th rectangle-shaped micro-strip antenna, the N12-th slot is disposed close to the first terminal of the T-shaped jointer and on the N1-th rectangle-shaped micro-strip antenna, the N21-th slot is disposed close to the N2-th arrow-shaped micro-strip antenna and on the N2-th rectangle-shaped micro-strip antenna, and the N22-th slot is disposed close to the second terminal of the T-shaped jointer and on the N2-th rectangle micro-strip antenna.

20. The dual-band planar micro-strip antenna of claim 19, wherein the N11-th slot, the N12-th slot, the N21-th slot, and the N22-th slot are rectangle-shaped, acute-triangle-shaped, trapezoid-shaped, or polygon-shaped;

wherein a longer side of the N1-th rectangle-shaped micro-strip antenna is vertical to a line crossing centers of both the N11-th slot and the N12-th slot;

wherein a longer side of the N2-th rectangle-shaped micro-strip antenna is vertical to a line crossing centers of both the N21-th slot and the N22-th slot.

21. The dual-band planar micro-strip antenna of claim 20, wherein each of the N1-th arrow-shaped micro-strip antenna and the N2-th arrow-shaped micro-strip antenna comprises a first curved surface and a second curved surface;

wherein the first curved surface is concave, and the second curved surface is protruding.

22. A dual-band antenna, comprising:

an antenna array, comprising:

a first component being rectangle-shaped, the first component having a signal feed-in terminal and comprising at least one slot; and a second component being curved-shaped, the second component being connected to the first component; and a T-shaped jointer for electrically connecting the dual-band antenna with a feed-in line.

23. The dual-band antenna of claim 22, wherein a length of the first component is corresponding to a first resonant frequency, and a length of the second component is corresponding to a second resonant frequency.

24. The dual-band antenna of claim 22, wherein a curve of the curve-shaped second component is designed according to an ellipse equation and is corresponding to resonance between a first resonant frequency and a second resonant frequency.

25. The dual-band antenna of claim 22, wherein the second component forms an arrow-shaped streamline pattern with a curved-shape of said second component.

26. The dual-band antenna of claim 22, wherein the first component forms a rectangle-shaped pattern with an L-shape of said first component.

27. The dual-band antenna of claim 22, wherein the first component comprises a first slot and a second slot.

28. The dual-band antenna of claim 22, wherein both the first component and the second component are comprised by a micro-strip antenna.

29. The dual-band antenna of claim 22 wherein one side of the T-shaped jointer comprises at least one L-shaped component.

30. The dual-band antenna of claim 22 wherein each of two sides of the T-shaped jointer comprises an L-shaped component.

* * * * *